US008984838B2

(12) United States Patent
Bordener

(10) Patent No.: US 8,984,838 B2
(45) Date of Patent: Mar. 24, 2015

(54) KIT AND ASSEMBLY FOR COMPENSATING FOR COEFFICIENTS OF THERMAL EXPANSION OF DECORATIVE MOUNTED PANELS

(71) Applicant: Robert B. Bordener, Bloomfield Hills, MI (US)

(72) Inventor: Robert B. Bordener, Bloomfield Hills, MI (US)

( * ) Notice: Subject to any disclaimer, the term of this patent is extended or adjusted under 35 U.S.C. 154(b) by 224 days.

(21) Appl. No.: 13/672,806

(22) Filed: Nov. 9, 2012

(65) Prior Publication Data

US 2013/0111840 A1 May 9, 2013

Related U.S. Application Data

(60) Provisional application No. 61/557,625, filed on Nov. 9, 2011, provisional application No. 61/654,452, filed on Jun. 1, 2012.

(51) Int. Cl.

| | |
|---|---|
| ***E04B 1/343*** | (2006.01) |
| ***E04F 13/08*** | (2006.01) |
| ***E04B 1/68*** | (2006.01) |

(52) U.S. Cl.

CPC . *E04B 1/68* (2013.01); *E04F 13/08* (2013.01); *Y10S 52/13* (2013.01)

USPC ..... 52/573.1; 52/483.1; 52/506.08; 52/506.9; 52/DIG. 13

(58) Field of Classification Search

USPC ..... 52/474, 479, 480, 481.1, 481.2, 483.1, 52/506.05, 506.06, 506.08, 506.09, 509, 52/511, 573.1, DIG. 13

See application file for complete search history.

(56) References Cited

U.S. PATENT DOCUMENTS

| | | | | | |
|---|---|---|---|---|---|
| 1,800,609 | A | * | 4/1931 | Drake | 52/461 |
| 1,940,968 | A | * | 12/1933 | Ohlis | 52/464 |
| 2,499,898 | A | * | 3/1950 | Anderson | 24/442 |
| 3,016,998 | A | * | 1/1962 | Buchmeier | 52/479 |
| 3,359,700 | A | * | 12/1967 | Birum, Jr. | 52/468 |
| 3,412,515 | A | * | 11/1968 | Finon | 52/480 |
| 3,721,050 | A | * | 3/1973 | Perina | 52/28 |
| 3,808,648 | A | * | 5/1974 | Billarant et al. | 24/450 |
| 3,863,412 | A | * | 2/1975 | Bodycomb et al. | 52/481.2 |
| 4,041,667 | A | * | 8/1977 | Lindner et al. | 52/481.2 |
| 4,117,641 | A | | 10/1978 | Wells | |
| 4,744,189 | A | * | 5/1988 | Wilson | 52/511 |
| 4,796,397 | A | * | 1/1989 | Capaul | 52/144 |
| 5,172,504 | A | * | 12/1992 | De Maat et al. | 40/605 |
| 5,417,020 | A | * | 5/1995 | Dobija | 52/235 |
| 5,505,029 | A | | 4/1996 | Lind | |
| 5,881,522 | A | * | 3/1999 | Dobija | 52/506.01 |
| 5,953,878 | A | | 9/1999 | Johnson | |
| 5,974,753 | A | * | 11/1999 | Hsu | 52/506.01 |
| 6,202,377 | B1 | | 3/2001 | Krieger | |
| 6,289,646 | B1 | * | 9/2001 | Watanabe | 52/506.01 |

(Continued)

*Primary Examiner* — Robert Canfield
*Assistant Examiner* — Charissa Ahmad
(74) *Attorney, Agent, or Firm* — Gifford, Krass, Sprinkle, Anderson & Citkowski, P.C.; Douglas J. McEvoy

(57) ABSTRACT

An improved panel system and installation process for maintaining panel contact on all four edges of its perimeter, while simultaneously maintaining full planar bearing suspension of the panel weight. A plurality of moldings are provided in varying combinations, and in particular for engaging each of the installed panels upon its outside edge corners, as opposed to by the panel ends, in order to provide engagement through a compressive force which does not pull the panel apart, rather acts to keep the panel together while under stress.

10 Claims, 12 Drawing Sheets

(56) References Cited

U.S. PATENT DOCUMENTS

| | | | | |
|---|---|---|---|---|
| 6,427,408 | B1 | 8/2002 | Krieger | |
| 7,836,646 | B2 | 11/2010 | Matsufuji | |
| 8,051,623 | B2 * | 11/2011 | Loyd | 52/747.1 |
| 8,151,533 | B2 | 4/2012 | Krieger | |
| 8,191,327 | B2 | 6/2012 | Griffiths et al. | |
| 8,322,102 | B2 | 12/2012 | Krieger | |
| 8,407,955 | B2 * | 4/2013 | Delforte | 52/235 |
| 8,511,014 | B2 * | 8/2013 | Delforte | 52/235 |
| 8,584,417 | B1 * | 11/2013 | Krieger | 52/483.1 |
| 2004/0010998 | A1 * | 1/2004 | Turco | 52/762 |
| 2009/0260311 | A1 * | 10/2009 | Boyer et al. | 52/506.06 |

* cited by examiner

FIG. 4
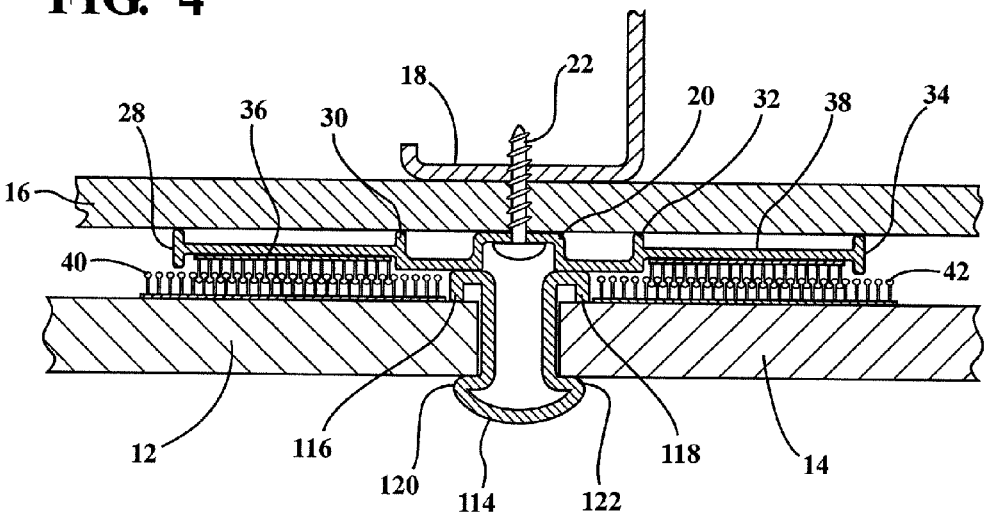
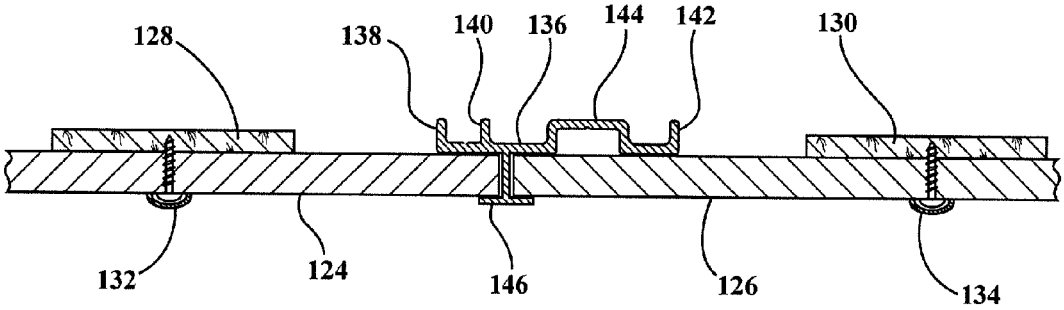
FIG. 5

FIG. 6
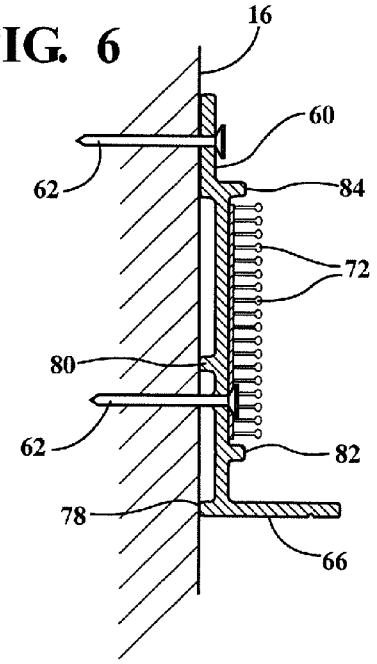
FIG. 7
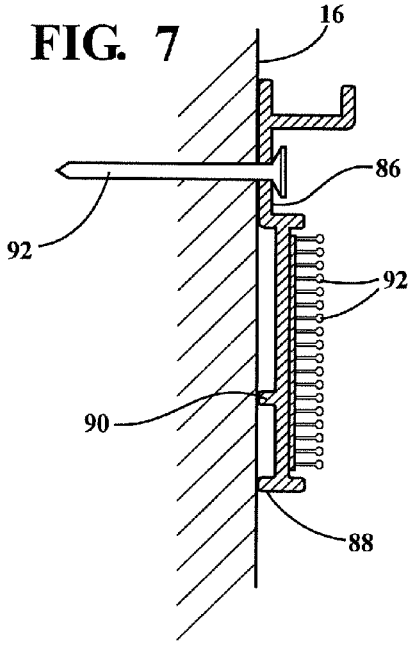
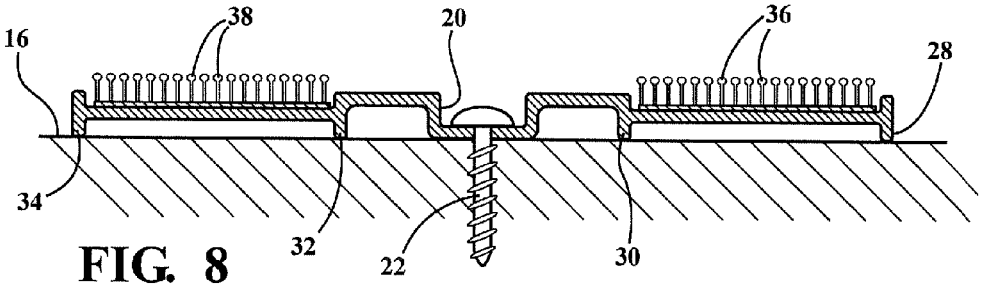
FIG. 8
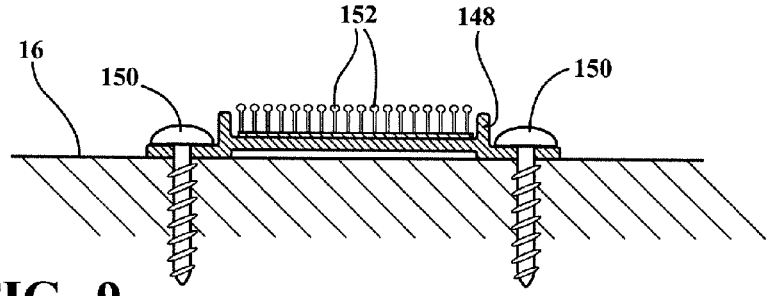
FIG. 9

KIT AND ASSEMBLY FOR COMPENSATING FOR COEFFICIENTS OF THERMAL EXPANSION OF DECORATIVE MOUNTED PANELS

CROSS REFERENCE TO RELATED APPLICATIONS

The present application claims the priority of U.S. Ser. No. 61/557,625, filed Nov. 9, 2011 as well as U.S. Ser. No. 61/654,452 filed Jun. 1, 2012.

BACKGROUND OF THE INVENTION

1. Field of the Invention

The present invention discloses a kit, assembly, and installation process with hardware used for securing and aligning wall panels into a functional and decorative array of arranged panels. The inventive panel system combines unique attachment mechanisms, layout, panel joinery, and accommodation for building movement. Further, the system provides several unique means for securing the system panels within a system framework, and for supporting the weight of each panel in such a manner that thermal coefficient's of expansion/contraction which are endemic to given installation environments will not otherwise result in warping or buckling of the panels at their mounting interfaces. The various configurations depicted herein also provide a maximum of air circulation behind the panels and which assist in avoiding mold or other environmental degradation. The system, kit and assembly additionally offers unique advantages over prior art including faster installation time, drastically reduced parts count and inventory requirement, the option of individually demounting installed panels, faster and simpler alignment of panels over uneven walls, sound absorption of both high and low frequency noise, interchangeability of decorative moldings, reduced materials cost, reduced installation cost, and superior ability to absorb building movement including a unique provision for individual panel movement to not affect or transfer any stress or movement to any other panel within the same arrayed installation.

The inventive panel system also allows for the option of accommodation for building movement while providing for simultaneous stable panel bearing support, and the option for system framework to remain in contact and alignment with all four sides of an installed panel, or alternatively (depending on the need parameters of the installation) the fourth (top) panel edge is adjacent a headspace of at least 1/32" and as much as 1/4", providing room for an unbalanced, unconditioned, or unstable panel to safely expand without disturbing other elements of the installed array of panels (see plastic spacer detail). Movement of architectural components occurs either during normal seasonal movement of the building, or in the natural expansion and contraction of the panels themselves by varying conditions of vibration, moisture, or humidity. Additionally, the present system avoids the requirement for drilling or otherwise machining the back side of the wall panels and provides several different mounting methods within the same system, while maintaining a unique mix of features and benefits not previously known in the art.

2. Background of the Relevant Art

Architectural panels are well-known in the art. Such panels differ from most wall coverings in that they typically feature mechanical attachment of some sort, or at the very least offer a thickness exceeding typical wallpaper-type coverings and are therefore generally thicker than 1/4", and are most commonly 5/16" to 3/4" in thickness.

Such panel systems are typically employed to conceal building wall irregularities and to protect and decorate wall surfaces in offices, hospitals, retail spaces, and building interiors. The panels are most commonly offered in wood grain, metallic, simulated grass, and other faux finishes. Substrate materials are most commonly plywood, wood flour, gypsum or other mineral (e.g. magnesium oxide, Portland cement) board, plastic, or combinations thereof.

Additional examples from the prior art include the panel attachment systems depicted in each of U.S. Pat. Nos. 6,427,408, 8,151,533 and 6,202,377, all to Krieger. In the Krieger, '533 reference, a modular wall system includes a number of decorative panels that are received in an extruded panel frame. Each of the frames is positioned by connecting them to a wall rail that is attached to the building. The wall rail and panel frame each have a groove that accepts a fastener or clip by interference or snap fit to attach the panel frame to the wall rail. The grooves have a dove-tail shape that permits a snap fit to secure the panels, while permitting the panels to be easily removed or reconfigured.

In each of the Krieger '408 and '377 references, the wall system includes a plurality of rectangular rigid prefinished panels mounted on a wall support structure with main runners and cross runners. The main runners serve to lock the panels onto the support structure and with the cross runners serving to prevent the wood-based panels from warping due to adverse moisture conditions. The main runners are configured to space the panels from the wall support structure to encourage uniform humidity conditions at the front and rear of the panels. Clips that secure the panels to the main runners are fixed adjacent the top and bottom panel edges at different setoffs to obtain an advantageous nesting of panels for reduced packaging volume.

SUMMARY OF THE PRESENT INVENTION

The present invention discloses an improved panel system and installation process which uniquely maintains panel contact on all four edges of its perimeter while simultaneously maintaining full planar bearing suspension of the panel weight and for allowing the panels to individually expand or contract, such as according to a given coefficient of thermal expansion associated with the panel being situated within a given environment. Panel edges may preferably be engaged at a 135° angle between the direction of the panel and the resistive force of the inventive molding, or without any resistive force by way of the panel headspace allowance included between the molding's splines and at the top and/or one side edge of the panel by use of a plastic spacer within the inventive molding. A further distinguishing feature of the inventive system is that the various supporting profiles engage the panels upon their outside edge corners or perimeter faces, and as opposed to by the panel ends as is accomplished in all prior art systems, the effect of such an engagement feature being a compressive force which does not pull the panel apart, rather it acts to keep the panel together while under stress, or elimination of the stress altogether at the option of the user.

Additional variants associated with the present assembly include providing for individually demountable panels while using inexpensive reclosable fasteners which are individually mounted such as be reverse face adhesive strips to each of inner faces of the panels and opposing outer faces of the surface mounted profile extrusions or other configurations, this in combination with the unique shaping of the profiles providing mounting of one side of the reclosable fastener, with additional vertically-oriented profiles establishing aligning contact with additional mounted panels along each adjacent side. The reveal profile is provided according to a variety of different designs and maintains contact along each vertical edge of each panel, even during movement of the panel or installation.

Demountable panels are also suspended in full bearing support along their bottom edge, such as through the installation of an additional elongated profile exhibiting a lip support lower edge which extends proximate a floor location. Demountable installations exhibiting multiple (two or more) rows of panels can feature a horizontal profile adjacent to the top running edges of panels.

Any of the profile configurations depicted herein can also exhibit at least one surface which is either flush with or spaced a distance from a sub-wall surface of the room (this defined as such as the underlying wallboard or drywall material covering the joists and to which the decorative panel assembly is mounted). In given applications, a sub-wall separation distance of a panel supporting profile can be less than an additional distance that may be accommodated by a reclosable fastener without disengaging therefrom.

The numerous examples of the panel supporting and vertical/horizontal intersecting profiles and also include each of a vertical profile supported upon a vertically-oriented dual seam strip. The dual seam strip can be designed to include two columns of reclosable fasteners along its length, with each column corresponding to a panel supported adjacent to the molding's left and right.

Additional features can include the reclosable fasteners being flexible (or movable) in at least two, and preferably each of three (xyz) dimensions concurrent with expanding/contracting movement of the supported panels. This is further accomplished in such a way as to maintain edge spacing between the multiple panels. The material construction of the various reveal profiles can also include, without limitation, such as aluminum or other thin walled materials which provide a desired combination of support and, where necessary, some dynamic deflection or give. Variant of the profile constructions, such as including the reclosable profiles described herein, can also be constructed of a rigid plastic or composite material.

BRIEF DESCRIPTION OF THE DRAWINGS

Reference will now be made to the attached drawings, when read in combination with the following detailed description, wherein like reference numerals refer to like parts throughout the several views, and in which:

FIG. 4 is a top plan view similar to FIG. 3 and which depicts an alternate configuration of a sandwiched vertically extending and panel edge supporting/displacement permitting component;

FIG. 5 is a sectional cutaway of an alternate decorative configuration associated with first and second wall mounted panels and which includes wood strips mounted to reverse faces of the panels for supporting decorative elements and providing consistent surface spacing with the panel edge supporting profile;

FIG. 6 is a cutaway side view of the floor proximate mounted profile of FIG. 1;

FIG. 7 is a cutaway side view of an intermediate height located and horizontally extending profile which, in combination with the floor proximate profile, supports opposite horizontal extending edges of the panels;

FIG. 8 is a top cutaway view of the dual panel supporting profile previously shown in each of FIGS. 1, 3 and 5;

FIG. 9 is a top cutaway view of a single panel supporting profile;

DETAILED DESCRIPTION OF THE INVENTION

With reference to the succeeding illustrations, the panel system and kit according to the several embodiments described herein provides bearing support for a plurality of panels assembled in a decorative supported array upon a wall interior and in such a way that the panels are permitted to expand or contract according to their determined thermal coefficient, such as resulting from a given set of environmental conditions. As is also known, extended running lengths of assembled panels and the underlying grid configured profiles required for mounting the panels can multiply the degree of expansion or contract, such as varying in intensity or degree over a significant time elapse not limited to changing of seasons, with the result being that an anticipated set of dimensional changes not anticipated for in the original installation can result in warpage, panel expansion, buckling or inadvertent disengagement of the panels from the underlying support structure.

As will be further described below, the present invention provides each of fixed and reclosable assemblies, the latter permitting individual panels to be demounted from the wall assembly without interfering with the remaining panel installation. Additional features of the present system and assembly include the ability to bear all a given panel weight, the multiple supported rows of panels not touching the floor and, as such, capable of being employed up a wall's height to any desired top end.

Figure 1:
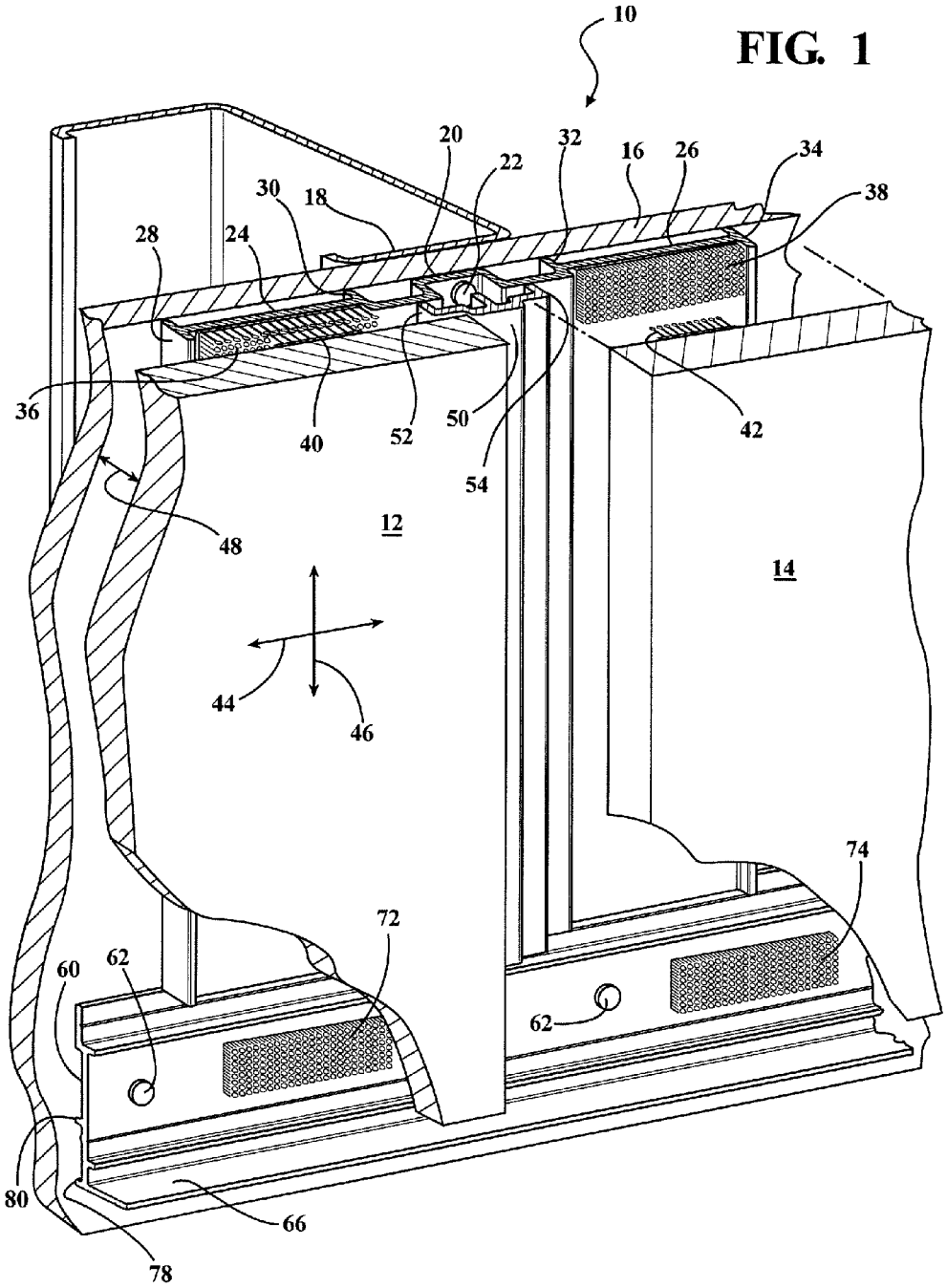
FIG. 1 is a perspective view of a replaceable panel attachment system according to a first embodiment for compensating for thermal coefficients of expansion of wooden or like decorative panels and which depicts a vertically extending panel edge supporting and displacement permitting component mounted upon a like extending inner profile in turn anchored to a substrate wall surface via a reverse facing joist, a floor proximate extending profile abutting a bottom extending edge of the vertically extending panel supporting components.

Referring initially to FIG. 1, a perspective view is generally shown at 10 of a panel attachment system according to a first embodiment for compensating for thermal coefficients of expansion of wooden or otherwise constructed decorative panels (see at 12 and 14). Without limitation, and as will be described in additional detail with respect to succeeding variants, the decorative panels 12, 14, et seq. can be provided in any plurality and with desired surface ornamentation. As will be further described, the panels each exhibit, without limitation, a square or rectangular profile with given crosswise dimensions corresponding to the underlying profile grid assembled to support it and, as further shown in succeeding illustrations, exhibit a variety of differing edge profiles designed to seat, support or abut with a variety of differently configured wall mounted profiles.

The assembly mounts to a sub wall 16, such as including without limitation any type of particle board or wall board material (and such as without limitation encompassing materials known under the technical description of gypsum or drywall). A plurality of joists or studs are provided arranged in a manner for supporting the sub wall 16, such as which are depicted at 18 in each of FIGS. 1 and 3 and which can include either metal "C" channel shapes in cross section, as depicted, as well as also including standard wood (such as 2×4) supports. The joists 18 are position on the rear surface of the sub wall 16 (which is typically secured to the joist using screws, nails, fasteners, glue, etc.).

Figure 3:
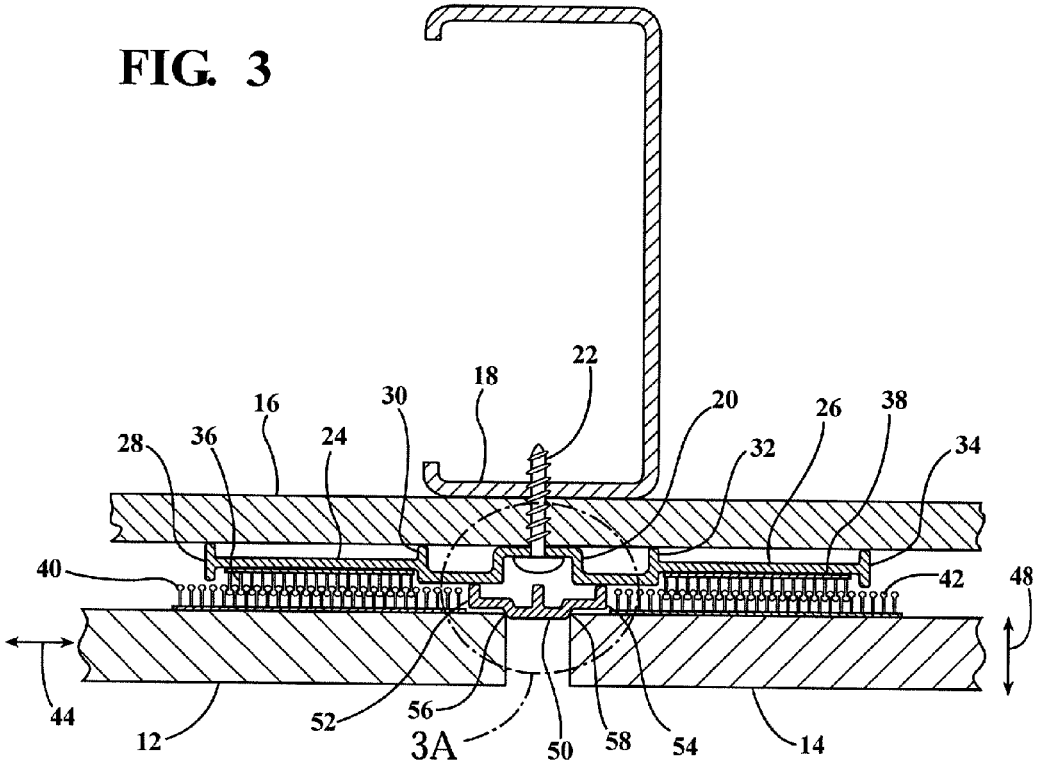
FIG. 3 is a top view of the vertical mounting profile of FIG. 1 and again depicting the manner in which the panel edge supporting and displacement permitting component is arranged in a generally sandwiched and free-floating (individually removable) manner between the panels, these in turn being supported by opposing and inter-engaging reclosable fastener strips which are pre-attached to each of inner surfaces of the panels and opposing and aligning exterior surfaces of the wall mounted substrate profile.

Given the above description, the present assembly includes the assembly of a plurality of profile components in a number of grid defining configurations in order to securely and dynamically support the edges of the panels 12, 14, et seq. As shown in FIGS. 1 and 3, this can include any number of vertically extending profiles and which is shown in cross section, exhibit a double panel edge supporting profile including a central most recessed area 20 through which are inserted any number of screws or like fasteners 22.

The double panel profile shown exhibits any elongated or height extending direction (as best shown in FIG. 1) with a pair of wing or lateral portions 24 and 26 which respectively align with proximate and inner edge extending portions of the panels 12 and 14. Without limitation, the profile (20, 24 and 26) is constructed of any suitable material not limited to an extruded aluminum or other lightweight metal and can also include durable plastics or other materials. As also shown in the crosswise depiction of the double profile, a plurality of sub wall support feet 28, 30, 32 and 34 are located at each of opposite end and intermediate spaced locations (these being arranged in pairs to define opposite lateral ledges of the wing portions 24 and 26).

As described, opposing pluralities of reclosable fasteners are provided for mounting the inner faces of the panels 12 and 14 to opposing and supporting surfaces established by the wing portions 24 and 26 of the double panel supporting profile. In one non-limited application, these fasteners (see as depicted by a first pair 36 & 38 secured to outer facing surfaces of the wing portions 24 and 26, as well as a second pair 40 & 42 secured to inner facing and aligning surfaces of the panels 12 and 14) can include a commercial product produced by 3M® under the technical name Dual Lock™ Reclosable Fastener.

The Dual Lock™ fastener system typically includes an elongated strip exhibiting a peel away adhesive backing for securing lengths thereof to any of vertical and/or horizontal extending locations of the profiles and panels. As further shown, the forward facing configuration of each Dual Lock™ fastener 36-42 exhibits a plurality of closely spaced bunches of individually flexible elements, such as without limitation polyolefin stems, these exhibiting rounded/bulbous heads. Without limitation, the stem bunches are provided in a desired density such that, and upon being intermeshed with an opposing stem bunch as best shown in FIG. 3, the panels are each permitted a degree of lateral (see arrow 44 in FIG. 1) and vertical (arrow 46) independent movement (as well as potentially a further degree of in/out movement as depicted by arrow 48 in relation to specified panel 12 owing to the intermeshing configuration of the stem bunches associated with a given inter-engaging pair of fasteners 36-42).

Without limitation other fastener constructions, such as variations of hook and loop fasteners or the like, can be augmented or substituted for those shown at 36-42 and without departing from the scope of the invention. These can further include other reclosable fastener systems such as hook and loop and interlocking stem and interlocking island systems such as known under the commercial names Lynx™ and QwikGrip™, and the like.

Figure 3A:
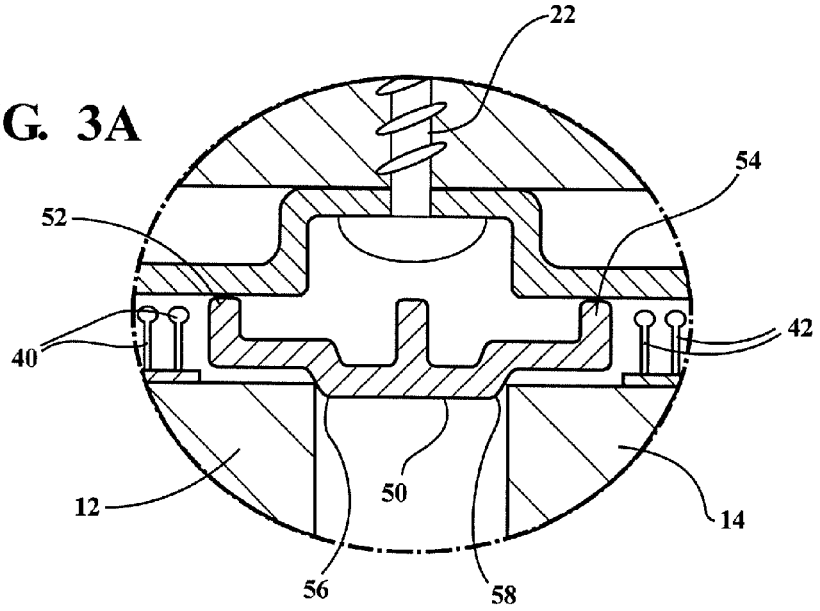
FIG. 3A is an enlarged partial view of the panel edge supporting and movement permitting end profile.

Also depicted in each of FIGS. 1, 3 and 3A is a vertically extending panel edge supporting and displacement permitting component, see at 50, supported in abutting fashion, via inwardly turned end feet 52 and 54, upon inner spaced locations proximate the center location 20 of the dual edge mounting profile. As further best shown in FIGS. 3 and 3A, an outer facing configuration of the component 50 includes angled sides 56 and 58, these respectively contacting angled inner edges of the panels 12 and 14.

Owing to the secure and multi-dimensional floating engagement afforded by the opposing pairs of fasteners 36 & 38 and 40 & 42, the inner panel edges bias and sandwich the vertically extending component 50 in a manner which retains the component 50 in contact with the exterior of the dual profile 20, while permitting the panels 12 and 14 a limited degree of independent or concurrent multi-axial motion in a manner which does not introduce any strain or deformation, while also permitting the inner panel edges to move along the sloped profile edges 56 and 58 of the sandwiched component 50.

Figure 22:
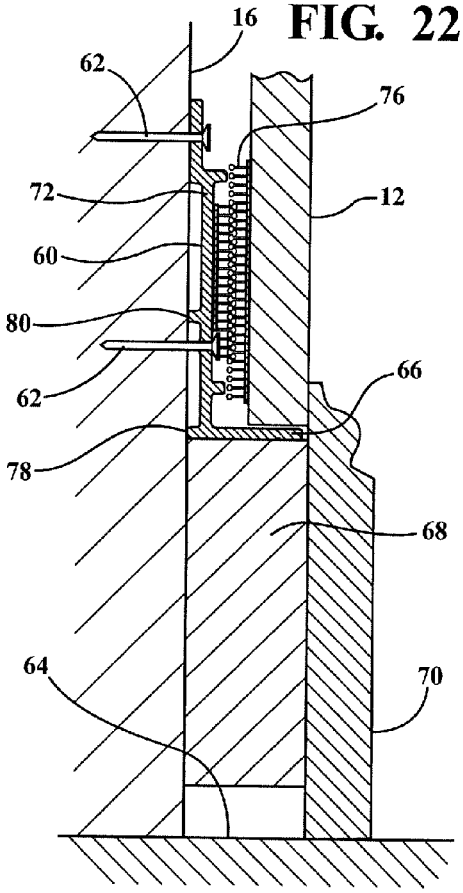
FIG. 22 is a side cutaway profile of the floor positioned J-bar installed in combination with a lower spacer and decorative covering baseboard elements.

A floor proximate extending support profile is provided as shown at 60 in FIG. 1 and exhibits a generally "L" or "J" profile in cross section. The component 60 is likewise constructed as an aluminum or durable plastic extrusion and is mounted to a floor proximate location of the wall, see as also depicted in FIG. 22 in which the floor extending profile 60 is mounted by nails or like fasteners 62 at a location relative to a floor 64, this so that a bottom lip 66 provides an elevated and abutting support to a bottom corresponding edge of selected panel 12. Additional features shown in cross section in FIG. 22 include a spacer block 68 positioned between the bottom surface of the sub wall attachable floor profile 60 and the floor 64, with a covering baseboard 70 or like fascia provided for completing the decorative appearance.

Figure 12:
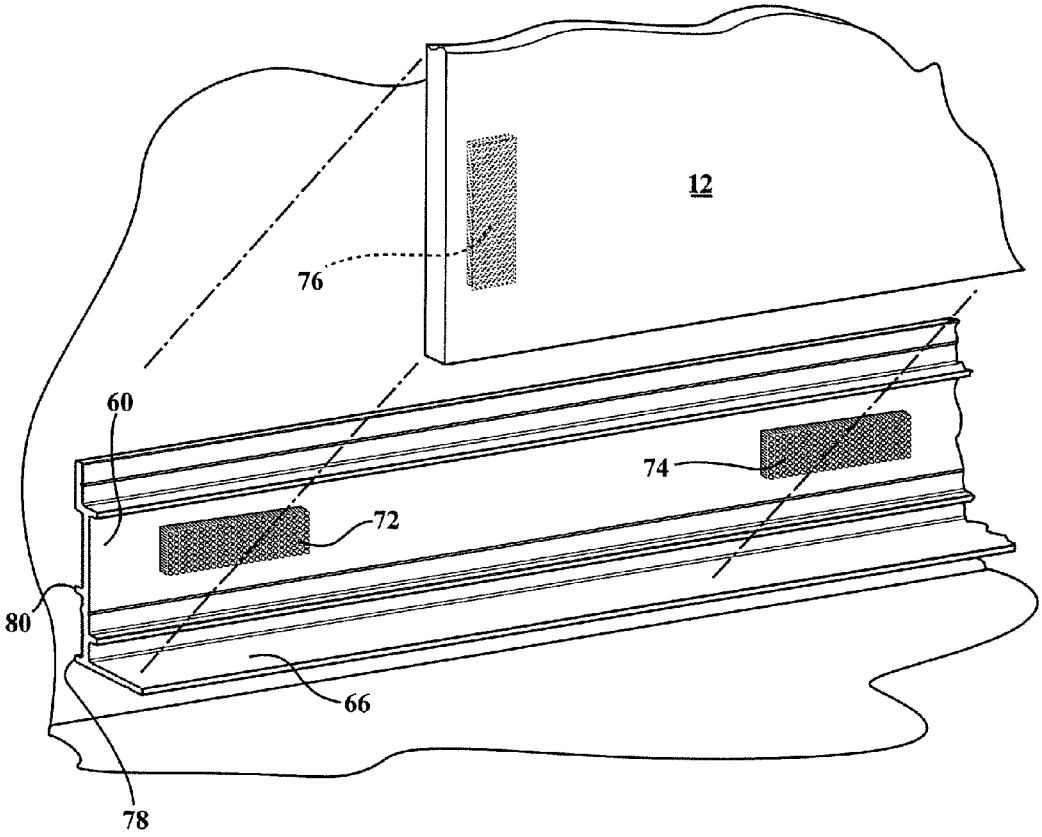
FIG. 12 is an exploded view of one potential arrangement of reclosable fasteners mounted to each of a lower floor extending J-bar and attaching panel.

As further depicted in each of FIGS. 1, 12 and 22, additional reclosable fastener strips are provided (similar in construction to those previously described at 36-42) and include such as spaced apart strips 72 and 74 attached to the outward facing vertical surface of the floor profile, these being interengaged in dynamically and incrementally displaceable fashion by any number of opposing/aligning/mating reclosable fasteners attached, at 76, to the inner facing surface of the panels (see as shown by panel 12). The floor profile 60 also includes feet supports depicted at 78 and 80 supporting against the sub wall 16, with additional outer facing feet 82 and 84 bounding the reclosable fastener strips 72 mounted to the exterior face of the floor profile 60 for defining an inward deflecting distance associated with the mounted panels 12.

Referring further to FIG. 7, a cutaway side view is shown of an intermediate height located and horizontally extending profile 86 which, in combination with the floor proximate J-bar profile, supports opposite horizontal extending edges of the panels 12 and 14. The profile 86 is understood to include one of a number of examples of horizontally extending profiles which, in combination with the vertical extending profile 20, are arranged in vertically spaced and parallel extending fashion such that they collectively define a sub wall affixed grid platform for receiving any number of the panels 12, 14 et seq., in plural horizontal and vertical stacked rows.

The profile 86 exhibits a number of features similar to that associated with the floor profile 60 and includes an arrangement of support feet 88 and 90 for leveling against the sub wall 16 upon installation of fasteners 92 through apertures defined in the profile. A reclosable fastener 94 as previously described is adhesively attached to the exterior face of the profile in a similar fashion as previously described and so that an opposing (inner) facing reclosable fastener (see at 96 in FIG. 13) applied to an inner face of a further selected panel 12 engages the fastener 92 is secured in a consistently affixed and incrementally movable fashion consistent with that previously described.

Figure 13:
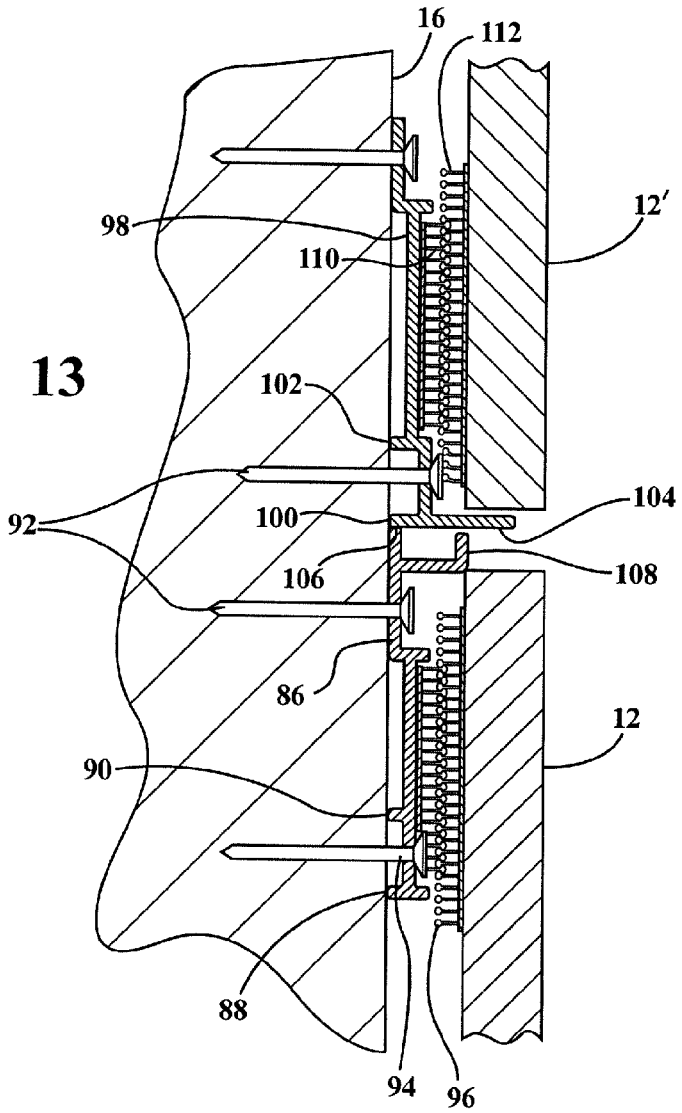
FIG. 13 is an illustration in side cutaway of a pair of stacked and horizontally extending profiles, including that shown in FIG. 7, for supporting a pair of panels along opposing edges.

As further shown, FIG. 13 is an illustration in side cutaway of a pair of stacked and horizontally extending profiles 12 and 12', including the profile 86 shown in FIG. 7 arranged in abutting fashion underneath a further configured profile 98 which is secured to the sub wall 16 using additional fasteners 92 and which includes additional pedestal feet 100 and 102 for leveling the profile 98. The lowermost foot 100 extends into a bottom lip 104 which establishes a lower deflection point for the upper stacked panel 12', uppermost inner 106 and outer 108 configured portions of the lower horizontal profile 86 defining abutting locations with the upper stacked profile 98 and for supporting the pair of vertically stacked panels 12 and 12' along opposing horizontal extending edges (again FIG. 13).

As also shown, opposing reclosable fasteners 110 and 112 are secured, respectively, to the surfaces of the upper horizontal stacked profile 98 and the inner surface of the upper vertically stacked panel 12' and, in combination with the dynamic supporting arrangement provided by the lower situated panel 12 and the additional supporting structure depicted in FIG. 1, collectively provide for multi-axial alignment of the panels, such as in response to environmentally induced changes in dimension resulting from the coefficient of expansion/contraction of the panels, this while maintaining a desired neat and orderly appearance to the decorative wall structure as well as maximizing ventilation and breathability of the panel to sub-wall interface in order to deter mold or the like.

FIG. 4 is a top plan view which is substantially identical to FIG. 3, with the exception that it depicts an alternate configuration of a sandwiched vertically extending and panel edge supporting/displacement permitting component 114 (this substituting for the earlier depicted component 50 in FIG. 3). The supporting component 114, as depicted in cross section, includes inner-most spaced apart and substantially "U" shaped support feet 116 and 118 which, in combination with the dynamic engagement established between the pluralities 36 & 38 and 40 & 42 of the reclosable fastener strips, provide for a degree of dynamic collapse and give to accommodate any thermal coefficient induced expansion or contraction of the panels.

The decorative bulbous shaping of the support profile 114 is supported in a similarly sandwiched manner between the inner edges of the panels 12 and 14 and the central location 20 of the inner sub-wall affixed profile. As further shown in FIG. 4, an inner circumferential lip edge of the profile 114 (see at cross sectional locations 120 and 122) is defined in an outwardly spaced fashion from the outwardly turned support feet 116 and 118 and collectively seats the inner planar edges of the panels 12 and 14 in dynamically supported and multi-axially displaceable fashion.

FIG. 5 is a sectional cutaway of an alternate decorative configuration associated with first 124 and second 126 wall mounted panels and which includes wood strips 128 and 130 mounted to reverse faces of the panels for supporting decorative elements (see capped fasteners 132 and 134). A panel edge supporting profile is shown at 136 and is dimensioned to include spaced apart support feet 138, 140 and 142 which, in combination with an inner stepped configuration 144, provides a consistent surface for mounting against the sub wall. A "T" shaped projecting profile 146 is depicted in a manner which seats the inner opposing panel edges in the manner indicated.

FIG. 9 further shows a is a top cutaway view of a single panel supporting profile 148 which is similar in function to the profile shown at 20 in FIG. 8 and, however which is limited to supporting a single vertical extending edge of an associated stacked array of panels (not shown). As opposed to the double edge profile 20 of FIG. 8, the single edge profile 148 of FIG. 9 is contemplated to be utilized at a location proximate to a vertical wall edge where a final row of vertically stacked panels is situated. As with previously described profile constructions, the single edge profile 148 is mounted by fasteners 150 to the sub wall 16 (this again including either a particle board or drywall material but which can also include a concrete or other solid wall construction). A reclosable fastener 152 strip is attached to an exterior facing surface of the profile 148 and which, consistent with other described profiles, can inter engage a mating and inner face secured fastener (such as depicted at 76 in FIG. 12) which is secured to a selected panel 12. Without limitation, the single or double edge profiles of FIGS. 9 and 8 can also be supported in either or both of horizontal or vertical grid defining fashion for supporting a decorative panel array in the manner previously described and shown.

Figure 2:
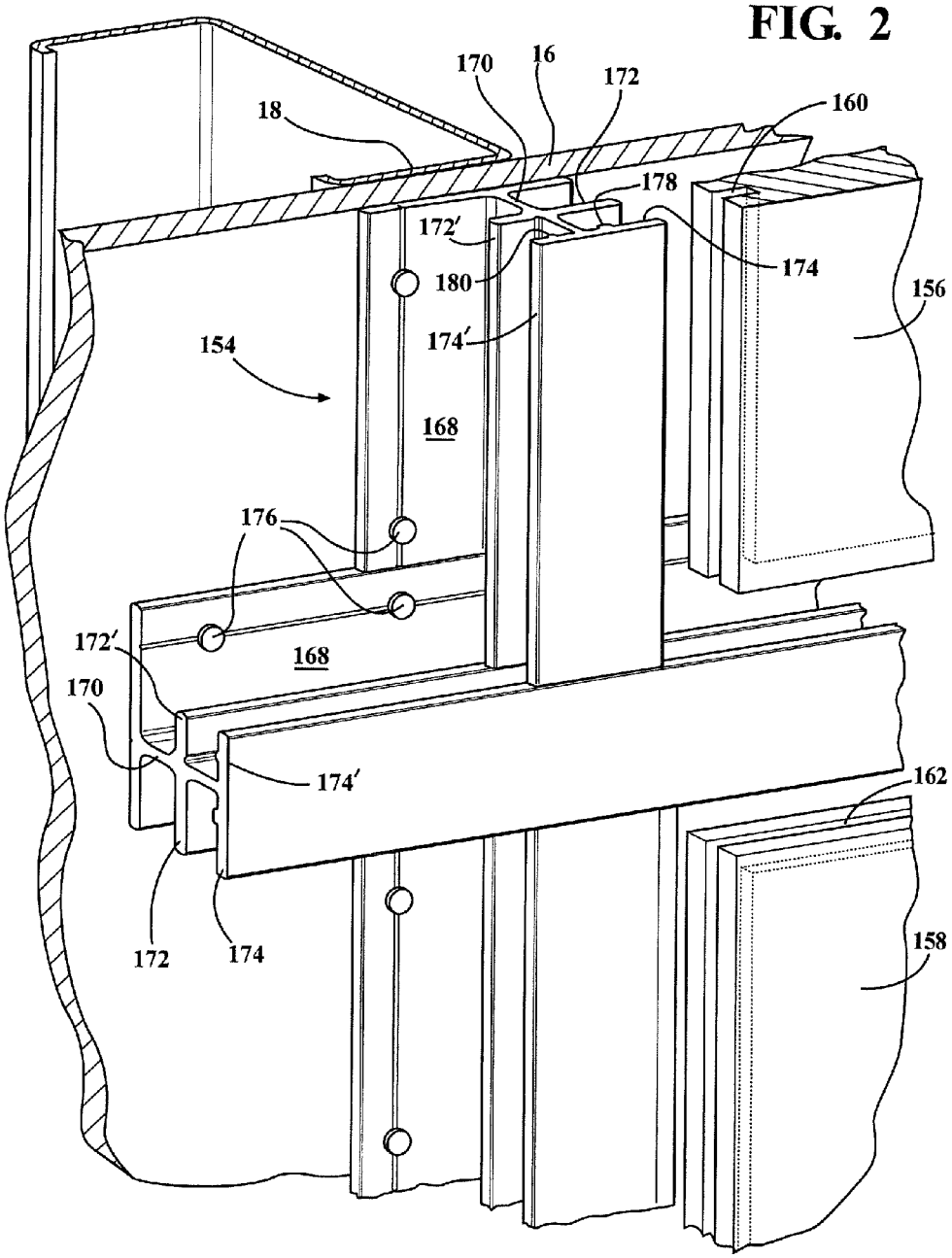
FIG. 2 is a perspective illustration generally at of a fixed panel attachment system exhibiting an alternate configuration of a cross shaped profile for mounting in place of the panel supporting and displacement permitting component and which in turn supports a plurality of panels in turn exhibiting reconfigured mounting edges in a like and relatively interdisplaceable fashion such as in order to compensate for thermal coefficients of expansion/contraction resulting from an environmental condition within which the assembly is installed.

Referring now to FIG. 2, an illustration is generally shown at 154 provided of an alternate configuration of a cross shaped profile for substituting in place of the removable assembly of FIG. 1. Consistent with the previously described variants, the channel configured profiles of FIG. 2, as well as those subsequently depicted in each of FIGS. 11A-11D, 14-21 and 23-25, permanently mount an alternate array of panels 156, 158 et seq., in an edge seating arrangement which differs from the panels 12 and 14 depicted in FIG. 1.

Figure 10:
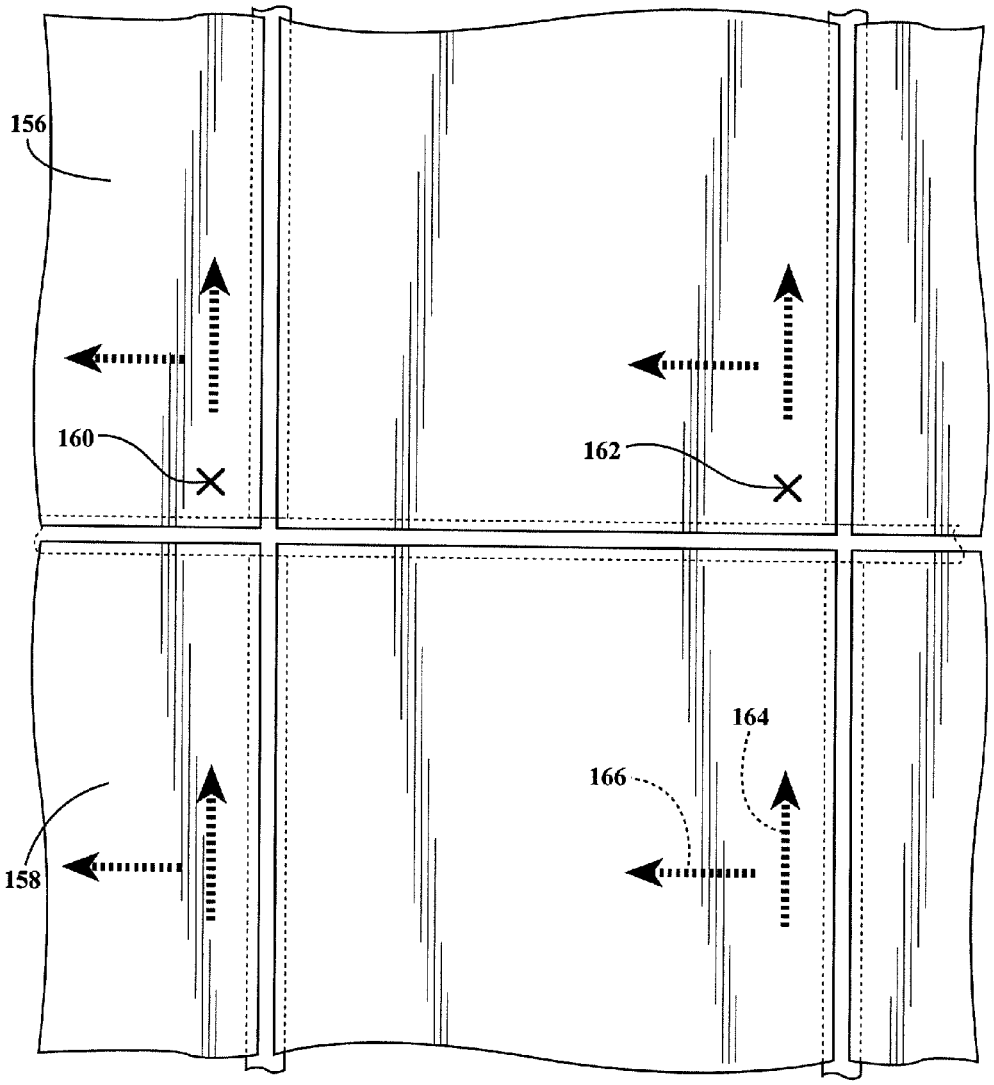
FIG. 10 is an operational plan view of a panel assembly depicting selected stationary corner supporting locations (X) combined with arrow designations depicting permitted multi-axial and thermal coefficient of expansion induced motion permitted the panels according to the present inventions.

In particular, the panels 156/158 each exhibit a recessed edge profile, see at 160 and 162, which differs from the flat edges of the panels 12 and 14 in FIG. 1 and which mount the panels 156/158 in an edge seating and multi-axial permitting fashion relative to the outer facing edges of the grid profile 154. In this fashion, the profile 154 permits the supported panels 156/158 to move in a selected combination of multi-axial direction (up/down, left/right, in/out) to again accommodate the thermal coefficients associated with the panel construction and is best depicted in the operation plan view of FIG. 10 in which selected stationary corner supporting locations (X), at 160 and 162 associated with panels 156 and 158 and, combined with arrow designations 164 and 166 depicting permitted multi-axial and thermal coefficient of expansion induced motion permitted the panels according to the several embodiments described.

With reference again to FIG. 1, in combination with FIGS. 11A-11D, the cross shaped profile 154 is constructed of a similar material as previously described and includes an inner sub wall mounting and planar lip or base portion 168. A web 170 extending from an intermediate and elongated surface of the base portion 168 supports both intermediate 172 and outermost 174 profile lips. As shown, the profile lips 172 and 174 are integrally formed with and extend in both lateral directions from the web 170 (see also opposite edge extending portions 172' and 174') for facilitating seating of channel defined edges, such as at 160 in FIG. 11A for selected panel 156.

A cross wise extending portion of the overall profile 154 as shown in FIG. 2 is identically constructed and referenced. A plurality of fasteners 176 is provided for mounting the cross wise and grid defining profile 154 upon the sub wall surface. As further depicted in each of FIG. 1 and FIGS. 11A-11D, varying configurations are shown of integrally defined embossments or protuberances, these for example shown at 178 and 180 for extending in inner facing and spaced apart locations of outermost lip portions 174 and 174'.

Figure 11A:
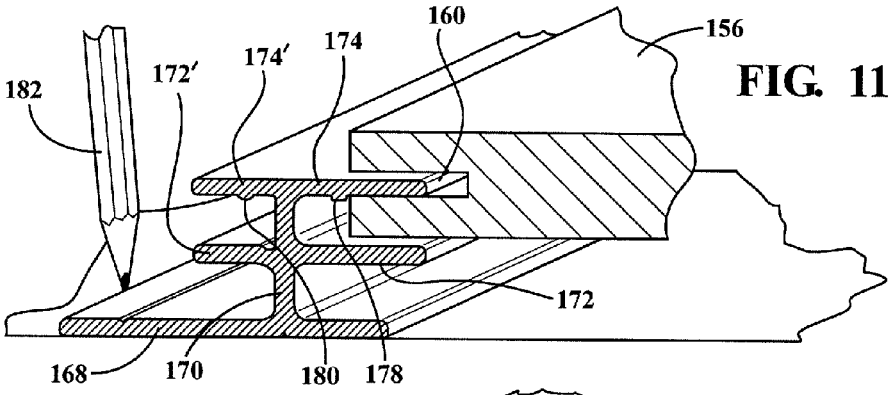
FIGS. 11A-11D illustrate a progression of views for installing a panel supporting profile such as depicted in FIG. 2.
Figure 11B:
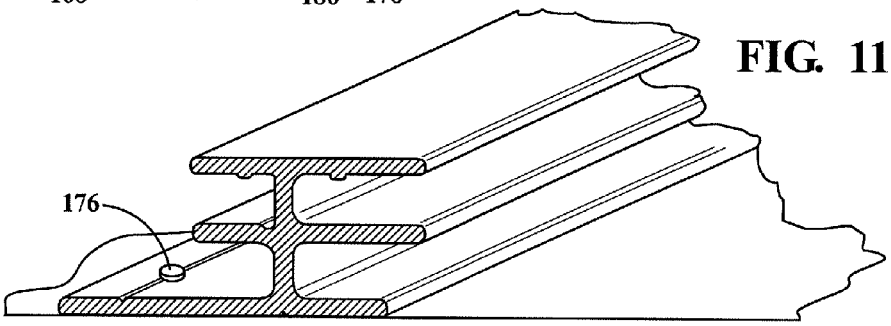

As shown in FIG. 11A, the inner recessed edge channel 160 of the selected panel 156 seats the lip portion 174 such that the outer panel edge abuts the selected protuberance 158 in a manner which permits a degree of multi-axial displacement of the panel. Although not shown, an additional panel can be installed in opposing fashion such that it seats selected outermost lip 174' in a like multi-axial and independently displacement permitting fashion.

FIGS. 11A-11D additionally depict a progression of views for installing a panel supporting profile as depicted in FIG. 2. This includes, in FIG. 11A, using a pencil or other marking instrument 182 for creating a level vertical or horizontal edge to which a selected running edge of the base lip 168 is aligned and fastened (at FIG. 11B).

Figure 11C:
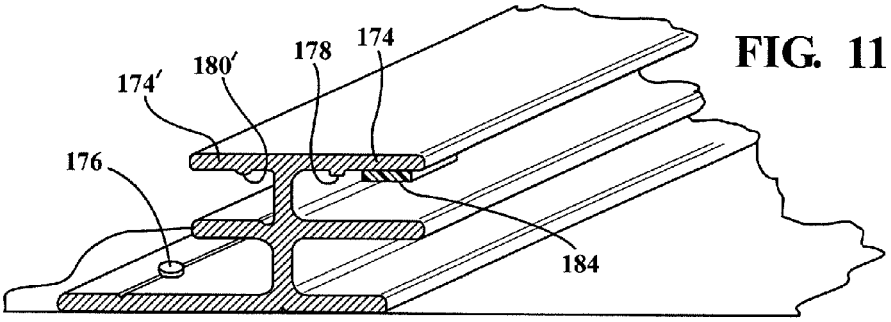
Figure 11D:
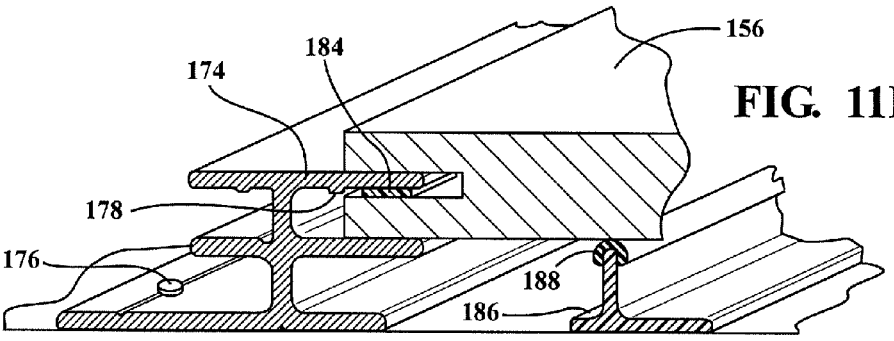

A cushioning strip 184 can be attached to an inner facing location of a selected lip 174 in proximate location to its integrally defined protuberance 178, see FIG. 11C. Finally, and at FIG. 11D, a secondary and independently installed supporting profile 186 can be provided affixed to the sub wall 16 a spaced distance from the seating interface established between the panel 156 and the main profile 154. The profile 186 includes a cushioned cap 188 which abuts an inner surface of the panel 156 and which, in combination with the edge seating profile established with the main profile 154, allows for an additional degree of inner abutting support to the panels while permitting two dimensional lateral motion of the panel combined with at least a minimal amount of in/out movement in the third dimension.

Figure 14:
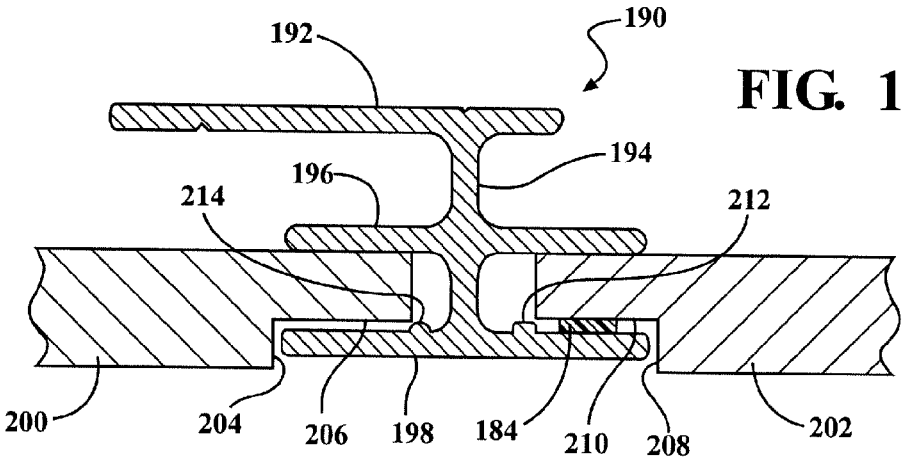
FIG. 14 is an illustration of a further variant of cross shaped and panel supporting profile, similar to earlier variants depicted in FIGS. 1 and 11A-11D, and depicting a further potential configuration in which strategically positioned and inwardly facing protrusions defined within the outermost lip, in combination with a cushioning and attachable strip, provide for effect thermal coefficient of expansion induced lateral and in/out movement of a further edge configured panel profile according to multi-axial directions.

FIG. 14 is an illustration in partial cross sectional cutaway of a further variant of cross shaped and panel supporting profile; see generally at 190, similar to earlier variants depicted in FIGS. 1 and 11A-11D. A base wall or lip 192 mounts to the sub wall (not shown) by a suitable fastener. An intermediate and elongated web 194 spaces intermediate 196 and outermost 198 lips in a similar arrangement, with the lips extending in both directions from the web 194 in order to seat additionally edge configured panels 200 and 202.

As further shown, the panels 200 and 202 exhibit inwardly stepped edges (see at 204/206 for panel 200 and further at 208/210 for panel 202). A cushioning strip 184 as previously described can be secured to an inner facing surface of a selected outermost lip 198 and, in combination inner spaced protuberances 212 and 214 exhibited on the lip 198, provide for thermal coefficient of expansion induced lateral and in/out movement of the panel profile according to multi-axial directions. It is noteworthy that a variety of edge configured panels can be utilized with like variations in the design of the profile (154 or 190) in order to seat the panels in a desired multi-axial displacement permitting fashion.

FIGS. 15-21 each illustrate in partial cross section a further potential variation of a profile adapted for supporting a different configuration of panel. Without engaging in a repetitive description of common elements consistently presented in each of the profiles, subsequent description will be limited to the variances in the arrangement of the integral protuberances.

Figure 15:
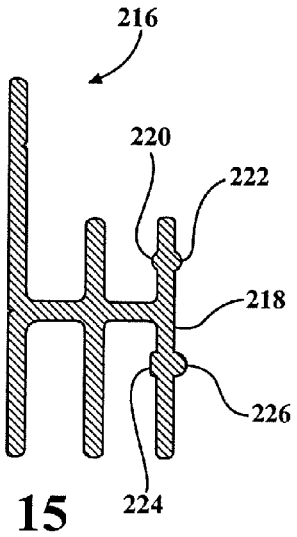
FIGS. 15-21 each illustrate in partial cross section a further potential variation of a profile adapted for supporting a different configuration of panel as contemplated in the present invention.

FIG. 15 depicts in cross section a similarly constructed profile generally at 216 and which exhibits, in an outermost web supported lip 218, both inner and outer configured protuberances 220/222 and 224/226 integrated into opposite extending locations of the outer lip 218 in a manner which seats an inner channel recessed configured panel (e.g. as previously shown at 156 and 160 in FIG. 11A).

Figure 16:
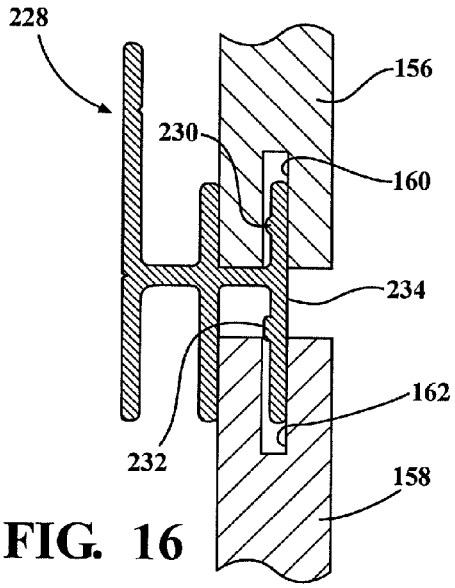

FIG. 16 illustrates, generally at 228, a further variant in which a pair of inner protuberances, including rounded upper protuberance 230 and widened and curved edge lower protuberance 232 are provided in outer web supported lip 234 and which, as shown, support an upper panel 156 in a manner such that its bottom outer edges is supported upon the web of the profile, the lower protuberance 232 defining an end abutment with the opposing outer edge of the lower situated panel 158. As constructed, the protuberance arrangement of FIG. 16 permits each of the panels 156/158 to move in multi-axial permitting fashion.

Figure 17:
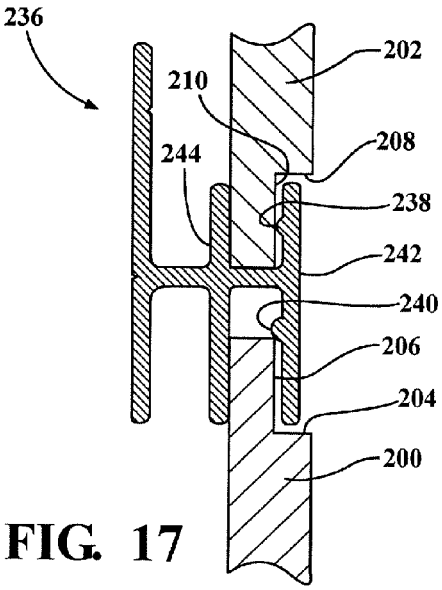

Proceeding to FIG. 17, a selected profile is generally shown at 236 of overall similar construction and which in particular depicts each of pointed 238 and rounded/bulbous 240 inwardly facing protuberances defined along inner facing locations of the outermost web supported lip 242. In this fashion, a pair of panels as previously depicted at 200 and 202 in FIG. 14 are capable of being installed in the manner illustrated and so that the outermost extending edge of the upper situated panel 202 rests on the inner web surface between the outermost lip 242 and intermediate 244 web supported lips. The lower installed panel 200 is further depicted such that its upper/outermost extending edge abuts an underside of the lower situated and rounded protuberance 240. As such, the panels 200 and 202 are permitted a degree of xy two dimensional displacement within its mounting configuration established with the cross shaped profile 236, this combined with a further incremental degree of in/out third dimensional movement.

Figure 18:
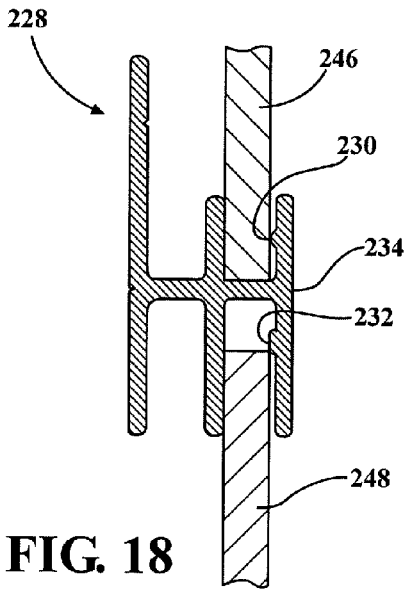

FIG. 18 is a repeat illustration of the profile previously shown in FIG. 16 and in which a further narrowed thickness pair of panels 246 and 248 each exhibit flattened edge profiles (similar to those exhibited by the removable panels 12 and 14 of the embodiment of FIG. 1). The flattened edges of the panels 246 and 248 seat in a consistent manner to that depicted by the panels 200 and 202 represented in FIG. 17 such that the embossments assist in facilitating the desired multi-dimensional misalignment permitting motion of the individual panels, again often resulting from thermal coefficient induced expansion or contraction of the panel, and again doing so in such a fashion as to maintain a generally consistent and appealing spacing between the various panels over the constructed wall surface.

Figure 19:
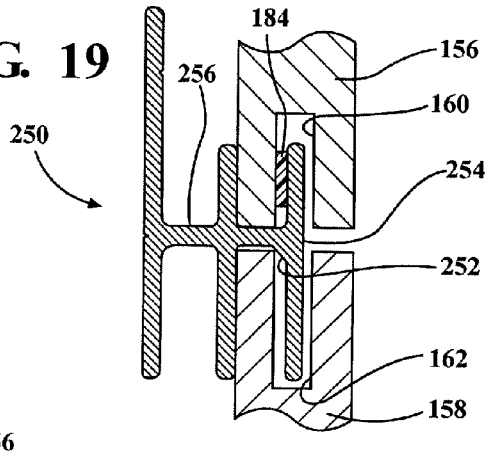

FIG. 19 is an illustration of a further selected profile 250, again of a generally consistent overall crosswise profile, and which incorporates a modified single embossment 252 exhibiting a straight edge at an inner corner established between the outermost lip 254 and the intersecting web 256. A cushion strip 184 as previously described is installed against an inner facing surface of an upper projecting portion of the outermost lip 254 for seating a recessed channel edge 160 of a panel 156 as previously depicted in FIG. 16, with a lower panel 158 seating, via its corresponding recessed edge 162, the lower projecting portion of the outermost lip 254 in such a fashion that an inward corner associated with the outer flat edge of the panel 158 abuts the angled protuberance 252 in a collectively multi-axial misalignment permitting fashion.

Figure 20:
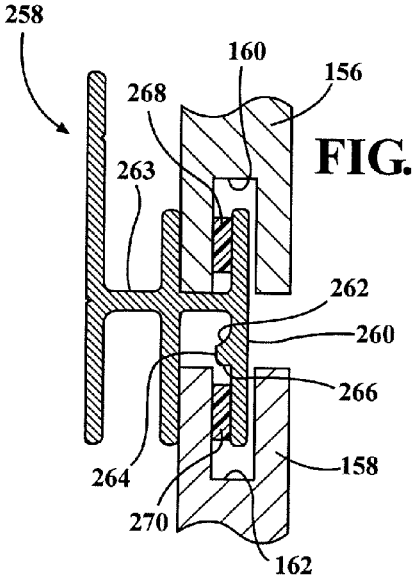

FIG. 20 is an illustration generally at 258 of a further variant of channel seating profile exhibiting a further configuration of protuberance depicted upon an inner facing side of an outermost web supported lip 260. The protuberance exhibits an arcuate ramping surface 262 extending outwardly from the central supporting web 263, the ramping surface 262 converging into a raised surface 264 and sloping back, at 266, along an outer seating edge until merging back into the outer lip 260. A pair of cushioning strip 268 and 270 are also depicted mounted to inside facing surfaces of both upper and lower extending portions of the outer lip 260, and which assist in seating the inner recessed edges 160 and 162 of the upper 156 and lower 158 panels, respectively, in a manner consistent with that previously described.

Figure 21:
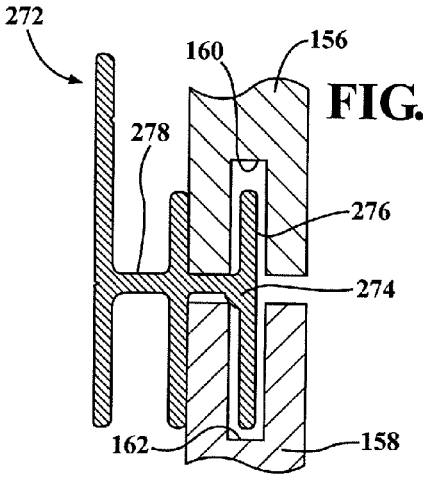

FIG. 21 is a further depiction at 272 of a profile extrusion largely similar to that depicted at 250 in FIG. 19, with the exception that the linear and inner corner edge protuberance is substituted by a convex or bubbled profile, at 274, exhibited along the inner corner established between the outer lip 276 and the supporting web 278. Although not shown, additional cushioning strips can be installed in this variant in order to modify the nature and degree of the seating and multi-axial support afforded the upper 156 and lower 158 panels.

Figure 23:
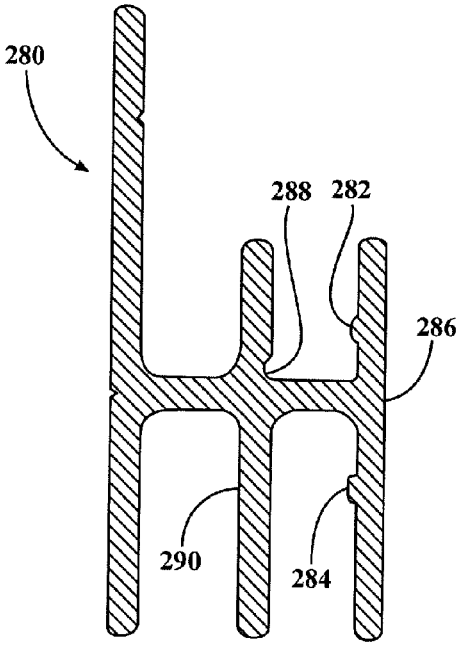
FIGS. 23-25 depict additional examples of variations in profile construction with different lip and integrated embossment profiles for supporting a variety of edge configured panels.
Figure 24:
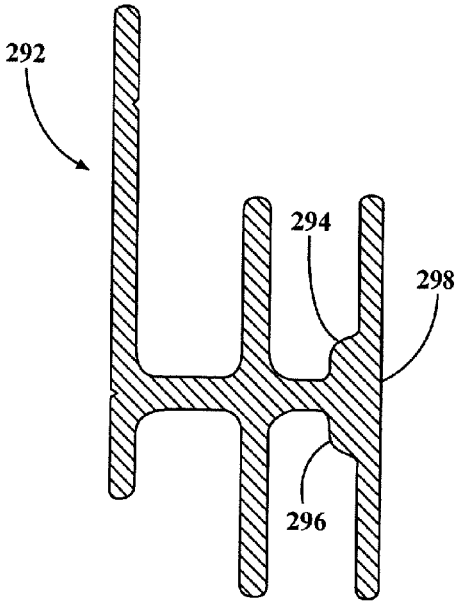
Figure 25:
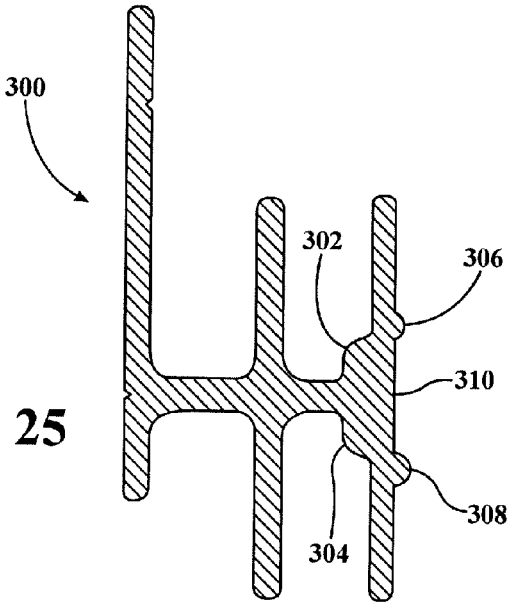

Yet additional profiles are shown in each of FIGS. 23-25, each of which depicting an additional example of a variation in profile construction with different lip and integrated embossment profiles for supporting a variety of edge configured panels not limited to those previously described. In the example of FIG. 23, profile 280 includes inner facing protuberances 282 (convex) and 284 (pseudo stepped) along inner facing locations of an outermost web supported lip 286. An inner/concave corner profile 288 is further depicted at an opposing/outer facing surface of an intermediate web supported lip 290.

FIG. 24 depicts, at 294, another variation of profile in which inner facing corners 294 and 296 of an outermost web supported lip 298 are likewise embossed in order to respectively depict a pair of mirrored and irregular stepped patterns for assisting in seating any of the panel configurations previously described. Finally, FIG. 25 depicts a yet further profile 300 in which like positioned inner embossments 302 and 304 (identical in representation to those shown at 294 and 296) are combined with additional outer convex/bubbled protuberances 306 and 308 associated with the outermost web supported lip 310, such a configuration being particularly suited for seating recessed channels edges of panels such as at 156 and 158 in FIG. 21.

Given the above reference descriptions, a variety of different installation protocols and notes as to specific features are presented as follows and which are intended to augment and further clarify the above detailed descriptions as applicable to either or both the replaceable panel configuration of FIGS. 1, 3, 3A, 4, 6-9, 12, 13 and 22, as well as the non-removable configurations of FIGS. 2, 11A-11D, 14-21 and 23-25. This includes the installation of seam support strips placed along the wall at given increments, such as without limitation every four feet on center. These seam strips may be mounted up to one-half inch out of place, and even out of plumb, without compromise to final panel alignment and gap consistency. The seam strips are similarly screw-attached to the wall structure, preferably down their center since that is the most likely location for blocking or studs.

The dual seam strips, which feature two columns of reclosable zero-liftoff fasteners, may be cut down their center to make two single-row moldings. With the two major aluminum mounting components installed, the system is nearly ready for final install. The decorative and aligning reveal profiles are then placed on the seam strip and secured with a small amount of silicone. The aligning component of the reveal profile is the raised center rib or "hat" which helps the installer gauge the horizontal space between panels. The reveal profile also aids in extra-system lateral load transfer to the sub wall in that any outside lateral load applied to an installed panel face will then transfer to the reveal profile as the reveal profile contacts the rear face of the panel adjacent to each long edge of the reveal profile and through the dual seam strip below and into the sub wall structure.

In this manner, the first wall panel is placed at one end of the wall and aligned up along one edge with the spline. The next panel is aligned along the other side of the spline and also detachably mounted with the re-closable fasteners to the seam support. When the wall is covered with installed panels, a crown molding may be screwed though the top edge of the wall panels. Also along the top edge of wall panels is either a single seam strip run horizontally so as to stabilize and help secure the panels, or a Multi-Row Support Molding or Reveal Molding for the same purpose.

The multi-row support molding features an upper flange which is designed to be exposed. The reveal extrusion also features a central raised section that is designed to be exposed. Both exposed sections' exposed faces are no more 0.035" proud of the rear face of the installed panel so that the panel, during a time of expansion, may expand and partly overlap the exposed section of the adjacent molding without creating or transferring any stress to an adjacent panel.

A panel system can also be provided which exhibits 6.3 mm thick magnesium oxide board substrates, and flame-resistant polyolefin faux veneers covering the substrate, and a 4 mm flexible spline set between panels to create a vertical reveal between the panels. A divider molding is inset on top of an aluminum seam strip. The upper width of the spline features flexible elements such that it can accommodate building movement such that rigid wall panels will not be exposed to undo stress or buckling forces while still maintaining contact with the panel edge on either side of it.

Also desirous is that there be a flexible element, such as a plastic pad between the rear face of each panel and the aluminum extrusion it is mounted to so that the panel will ideally yield slightly when an outside transverse load is applied to the panel and to further facilitate panel movement without stress such as when a panel may expand and partially overlap an adjacent exposed face of an extrusion. The 3M® Dual Lock® fastener comprises the flexible pad and the reclosable fastener in one component, but the two components may be achieved separately such as with conventional hook and loop fasteners with one side mounted to a flexible strip of plastic or by using rare earth magnets, which are easily found with sufficient strength, also mounted with a flexible plastic or rubber pad mounted to at least one side.

All screws and mounting hardware are concealed within the finished base and/or crown moldings (such as depicted in the example of FIG. 22) and both aluminum support moldings via recessed channels therein. Additional options include a base molding covering the support channel, with a crown molding covering and securing the top edge of the panels into the structure behind. Up to the entire bearing of the panels may be supported by the floor supporting profile 60 or associated support reclosable fastener strips (e.g. at 72 and 74 in FIG. 1) along the bottom of the panels 12 and 14, while the panels remain slidingly engaged upon such bearing support.

The zero lift-off reclosable fasteners are adhesively bonded to the aluminum support and seam strip pieces and to the backside of the decorative wall panels supported by this system. Without further limitation, the panel constructions as set forth in the aforementioned description may include, but are not limited to each of Phenolic, wood, plywood, MDF, Gypsum, MgO, concrete fiber, agri-fiber, and the like.

The reclosable fasteners are further understood to be oriented ninety degrees from one another (see again as specifically shown in FIG. 12 at 72 and 76) so as to maximize the alignment flexibility while maintaining a constant surface area of engagement between the panel 12 and the floor (or "J") profile 60. In one non-limiting application, each fastener location features a minimum of one square inch of fastener engagement.

The grid defining and aluminum profile framework as described above is secured to the sub wall or other surface structure via screws penetrating into the wall structure behind the sheetrock. Nearly any decorative surface or material may be used between the panels (such as within the typical 4-8 mm wide reveal, which may be from 1 mm to 16 mm wide overall). This can further include the use of brushed stainless steel, copper, aluminum, with decorative finishes applied to the reveal molding itself or an insert therein. The reveal molding being separate from the seam strip molding provides a simpler task of coloring any reveal (such as shown at 50 in FIG. 1)

The various examples of system moldings and panels again feature a series of interconnecting and engaging surfaces. Whether the panel edge is non-machined, rabbet-edge machined, or two-spline (dado) machined, each serves to locate each panel within the system and provide for some (if not necessarily all) allowance for movement in any combination of multi-axial directions as facilitated by the moldings and profile constructions. This in particular can be reflected in panel movement while acting upon the panel's outside corners and not upon the ends, such as known in prior art systems.

Each molding's second (middle) spline also serves to support the panel back side against lateral loads that may be applied to the system from outside forces such as a grab rail, or wall impact, etc. As such no load outside of the panels themselves, whether transverse or in line with the panel, can ever impart any load into a dado to cause it to split or fracture.

The only movement near any panel dado is the flexing of one panel spline around the "bead" of each molding and that load and movement is carefully directed at an angle of 100-170 degrees (135+/−35) between the panel and the molding and is never 180 degrees. Such an angle is facilitated by either a convex curvilinear surface or an angled ramp or wedge-shaped surface between the two splines along the long edge of a molding. This includes a panel system intended for panels typically from 6 mm (¼")-12 mm (½") thick solid phenolic, solid plastic, aluminum honeycomb, up to ¾" MgO, or MDF panel material, and a ¼"-⅜" (ideally 5⁄16") deep spline to be securely set into the 5⁄16"-½" (ideally ⅜") wide section of each panel's perimeter (or at least two edges thereof), with the lower edge of the panel bearing 100% of its weight onto the supporting molding directly below each panel containing the spline along that panels bottom edge.

It should be further noted that none of the panel's weight is focused into the panel dado or rabbet so the panel is not under any stress to split or crack. Various sections of the splines can also feature a bead-shaped detail contacting the panel perimeter functioning to allow for movement as the panel expands and contracts with environmental changes and/or building movement while still maintaining contact with the panel's edges. This can be a double bead contacting both the front and rear splines of the panel or, alternatively, can be exhibited by a single bead contacting against the panel's rear spline only.

In each of the afore-mentioned variants, all screws and mounting hardware are concealed behind the visible moldings (e.g. see again at 50 in FIG. 1 and further at 114 in FIG. 4). The entire weight of the panel is supported by the splined molding in contact with each panel's lower edge, with all panels remaining slidingly engaged upon such bearing support.

The inventive moldings are oriented around the perimeter of the orthogonal panels so as to engage all four of the panel edges while applying some compression forces to at least a portion of three of the edges of each panel to make a secure retention of each panel. Each panel's bottom edge also has a spline, but that edge does not flex around any bead and bears the 100% of panel's weight on its spline.

With the moldings securing against the panels via a compressive force (as opposed to a tensile force as in all prior art systems), the use of mineral-based substrates such as gypsum and cement boards such as Portland cement and magnesia cement-based panels become viable. This feature allows such a system to compete directly against finished-in-place drywall (and other mineral-based panel-based) systems which are prevalent in construction today. A reason for this is that mineral panels are not stable in tensile across their thickness, but only in compression.

In one exemplary system, each vertical engagement is configured so that the molding is just touching the corresponding panel's exterior edge (not panel end) at a 135° angle. As a result, any panel movement causes a corresponding minor opening, closing and/or flexing of a corresponding section of the molding's two splines upon or the panel's spline, and such contact occurs along the panel's exterior edges.

The top (horizontal) edge of each panel supplies 100% of the vertical allowance of expansion and contraction, which may vary depending on the height of the panel. For this reason, the reclosable variant of the present system may be used to allow for greater room for expansion.

Additionally or alternatively, greater vertical clearance may also be allowed for by eliminating the bead of the upper panel and using the inter-spline clearance as space for the panel to move. Setting this revised Horizontal Reveal in place is referenced by either a reference line machined into the molding or via a flexible plastic spacer set on or adjacent to the top edge of the panel prior to engaging such as a horizontal extending reveal or molding.

As in all of the inter-related variants of the fixed and removable panel embodiments of the inventive system, the aluminum framework is secured to the structure via screws penetrating into the wall structure behind the sheetrock, and possibly a small amount of adhesive. In the reclosable variant of the inventive system (FIG. 1) the exposed section of the reveal moldings can include a decorative feature of the system which may further be painted, coated or anodized as desired. The exposed reveal (e.g. again at 50 in FIG. 1) may be nearly any dimension not limited to 4-10 mm up to generally 30 mm in width. As is shown, a decorative tape or a "T"-shaped insert may also be used.

The splined variant of the inventive panel system uses very few simple components to provide performance and benefits beyond that of what is available from the very complex prior art systems today. The system can include, in one non-limiting application, a plurality of up to five moldings (horizontal reveal, vertical reveal, inside corner, outside corner, starter), with the horizontal reveal molding being the only mandatory component. The horizontal reveal, in it's headspace-allowance variant form may be used to replace both the vertical reveal and separate horizontal reveal moldings as depicted.

The panels of the inventive system further do not require that they be drilled or fabricated on the rear face which alleviates the requirement of flipping and re-orienting the panels in a CNC machine (or subsequent multiple operations with a shaping tool) and, with only one component (molding) at each location, there is no requirement to reference one component's location against the other within the system. In this manner, installation is greatly simplified and makes the system truly field fabricatable and install-able by non-specialized, local workers.

Other considerations include the inventive system variant flexing outside of any cut or machining of the panel edges, such that it maintains constant contact via a safe and stable compressive force upon the perimeter edges even during movement. Further still, the present system provides additional lateral support against loads imparted to the panel by means outside of the dado or machined panel perimeter, wherein the panel is at full thickness, full strength, and has no crack starters or cuts into it.

It is again notable that the present system primarily engages the panel edges and not on their ends. By engaging the panels at their edges and not on any panel end (except for the lower panel edge for bearing as depicted by example in FIGS. 19-21) but along only the exterior corners of the edges themselves, this manner of engagement is then across a line and therefore has no surface area (or at the very least minimal geometric surface area), and therefore has the least resistance to movement as the panels swell and move in a natural way.

In this manner, a lineal engagement is focused at an angle of typically 135°±/−25°, and is generally not less than 120°, and generally not more than 150°, but may be as much as 170°, and as little as 100°. By deflecting the forces from movement into the interior face of the rear spline of the inventive moldings (90°/lateral orientation from the plane of the panel installation), the resultant and inevitable forces of expansion are not allowed to accumulate from panel-to-panel, as they would via a typical prior art system featuring 180° engagement.

It has been found that this non-lineal angled engagement is an important point since the panel's bearing is focused across an area (and not in lineal fashion) so the panel's forces are not additive from one panel to the other, and so the location of each panel remains substantially constant and the panel only moves as it swells or shrinks with changes in ambient moisture or temperature or as the building itself moves, along the three non-load bearing edges. This uniquely creates a moving panel with a constant location that accommodates such movement within that location. It is also noteworthy that the present system also does not require the panels to be secured by some secondary means to preclude them from wandering out of place along the wall.

By obviating the need for an adhesive bed to retain the panels, as with most C.E.G. installations, the present system eliminates many of the extraneous components associated with the prior art. The present system is also stock-able at multiple locations which can be sold directly to the persons performing the work, thereby reducing cost, lead times, and the necessity for jet and truck travel around the country to perform installations.

Further still, the panels that are to be retained into the system do not have to be shipped to a common location with the moldings so that they can be fabricated and referenced against one another and then re-shipped to the job site. This saves significant travel, and the cost and environmental impacts therefrom.

It has also been found that the present system is very forgiving during the installation process and can be designed so that the panels arrive from the original location, with the hardware being shipped in separately, thereby reducing logistics requirements from multiple shipping of the typically very heavy and bulky wall panel materials. It should also be noted that the combination of the elimination of the double shipping of the panels and the elimination for the need of a special crew to travel across the country to perform the installation greatly reduces the carbon emissions associated with this system.

A final variation in use of the splined variant of the inventive system is that is can be mounted directly to the building subwall studs, obviating the need for drywall sheathing—saving much time and cost in commercial or residential construction. In such an application, a plurality of up to four studs are engaged by every four foot wide panel, with the first and fourth studs receiving an inventive splined molding screw-attached directly to them, and the middle two studs (studs two and three) being first covered by a batten so that may serve either or both of two purposes: to space the panel in parallel fashion equal with the two splined moldings, and to spread any applied lateral forces from the wall panel across a wider surface area by the battens typically being about 6" wide rather than the stud faces being only 1.5" wide. Lastly, this system is applicable in a single panel row usage, and in which the panel weight is supported by an integral base molding which may be made of composite concrete fiber, wood or plywood, plastic, or other equivalent material.

Having described my invention, other and additional preferred embodiments will become apparent to those skilled in the art to which is pertains and without deviating from the scope of the appended claims.

I claim:

1. A wall panel attachment system for use with a vertically supported sub wall, said system comprising:

a plurality of elongated profiles adapted to being secured to the sub wall, each of said profiles having a pair of laterally extending wing portions;

first and second panels, each having a thickness separating front and back surfaces and surrounded by four interconnecting sides;

a first plurality of individual bunches of reclosable fasteners secured to said laterally extending wing portions;

a second plurality of individual bunches of redo sable fasteners secured to locations along said back surface of each of said panels and aligning with said first plurality of bunches upon arraying said panels in proximate and opposing fashion to a spaced apart pair of said profiles;

an elongated supporting component positioned over a central extending location of each of said elongated profiles, said elongated component having at least one inner support surface abutting a flat surface of said elongated profile, an exterior of said elongated component further exhibiting profile edges which define contact locations with angled back edges of said panels and upon said panels being attached to said profiles; and displacement of said panels in at least a lateral direction relative said elongated support component maintaining a constant edge spacing between said panels owing to a floating arrangement of said supporting component between said panels and elongated profile, and accommodated by movement of said inner support surface upon said flat surfaces of said profile.

2. The wall panel attachment system of claim 1, further comprising a second elongated profile adapted to being secured to a horizontally extending surface of the sub wall proximate a floor location.

3. The wall panel attachment system of claim 2, further comprising said second profile exhibiting an "L" shape in cross section with additional bunches of reclosable fasteners secured in spaced apart fashion therealong.

4. The wall panel attachment system as described in claim 3, said "L" shaped second profile further comprising inwardly facing feet supports.

5. The wall panel attachment system as described in claim 4, said "L" shaped second profile further comprising an upper horizontal extending lip vertically spaced from a larger horizontal bottom lip, between which are received therethrough fasteners for mounting to the sub wall.

6. The wall panel attachment system as described in claim 2, further comprising said profiles being constructed from at least one of extruded aluminum, metal or plastic materials.

7. The wall panel attachment system of claim 1, said reclosable fasteners each further comprising intersecting bunches of stems including bulbous end profiles which facilitate mounting of said panels in multi-axial displaceable fashion.

8. The wall panel attachment system of claim 1, said elongated profiles each further comprising a central recessed area between said laterally extending wing portions, through which are inserted fasteners for securing said profiles to the sub wall.

9. The wall panel attachment system as described in claim 1, further comprising said panels being constructed from at least one of magnesium oxide board, medium density fiberboard, wood, wood composite, metal, phenolic resin impregnated paper and/or cloth, wood fiber and plastic materials.

10. The wall panel attachment system as described in claim 1, said at least one inner support surface of said elongated supporting component further comprising inwardly turned end feet.

* * * * *